US008043524B2

(12) United States Patent
Beckler et al.

(10) Patent No.: US 8,043,524 B2
(45) Date of Patent: Oct. 25, 2011

(54) SYNTHETIC REFRIGERATION OIL COMPOSITION FOR HFC APPLICATIONS

(75) Inventors: Phil Beckler, The Woodlands, TX (US); Liwen Wei, The Woodlands, TX (US)

(73) Assignee: Shrieve Chemical Products, Inc., The Woodlands, TX (US)

( * ) Notice: Subject to any disclaimer, the term of this patent is extended or adjusted under 35 U.S.C. 154(b) by 0 days.

(21) Appl. No.: 12/955,592

(22) Filed: Nov. 29, 2010

(65) Prior Publication Data

US 2011/0068292 A1 Mar. 24, 2011

Related U.S. Application Data

(62) Division of application No. 11/855,007, filed on Sep. 13, 2007.

(60) Provisional application No. 60/825,839, filed on Sep. 15, 2006.

(51) Int. Cl.
*C09K 5/04* (2006.01)
*C10M 129/76* (2006.01)

(52) U.S. Cl. ..... 252/68; 508/501; 426/611; 426/612; 554/30; 554/213

(58) Field of Classification Search ..... 252/68; 508/501; 426/611, 612; 554/30, 213
See application file for complete search history.

(56) References Cited

U.S. PATENT DOCUMENTS

| | | | |
|---|---|---|---|
| 4,123,416 | A | 10/1978 | Potter et al. |
| 4,317,760 | A | 3/1982 | Tsuda et al. |
| 5,489,618 | A | 2/1996 | Gerkin |
| 5,593,957 | A | 1/1997 | Obara et al. |
| 6,008,169 | A | 12/1999 | Kaneko |
| 6,306,803 | B1 | 10/2001 | Tazaki |
| 2002/0039973 | A1 | 4/2002 | Baum et al. |

FOREIGN PATENT DOCUMENTS

| | | | |
|---|---|---|---|
| JP | 63205394 | A | 8/1988 |
| JP | 2007262208 | A * | 10/2007 |

OTHER PUBLICATIONS

"Polyhydroxyalkanoates", Wikipedia, Jun. 7, 2011, pp. 1-5.*
USPTO Office Action Dated May 26, 2010 for U.S. Appl. No. 11/855,007.
USPTO Office Action Dated Dec. 1, 2009 for U.S. Appl. No. 11/855,007.
USPTO Office Action Dated Jul. 29, 2009 for U.S. Appl. No. 11/855,007.
USPTO Office Action Dated May 28, 2009 for U.S. Appl. No. 11/855,007.
International Search Report, International Application No. PCT/US2007/075842, dated Jan. 24, 2008, 2 pages.

* cited by examiner

*Primary Examiner* — Douglas M C Ginty
(74) *Attorney, Agent, or Firm* — Porter Hedges LLP; Timothy S. Westby

(57) ABSTRACT

Novel refrigeration compositions comprising at least one ester of a hydroxycarboxylic acid which can have a chain length in the range of from 8 to 22 carbon atoms. The composition can contain a carrier fluid or base oil selected from alkylbenzenes, alkylated naphthenics, polyalkylene glycols, polyvinylethers, polyalphaolefins, mineral oils, polyol esters, and combinations thereof, providing improved fluidity and heat transfer, and enhanced oil return. A method of making a refrigeration composition by preparing at least one ester by esterifying a first component comprising at least one hydroxycarboxylic acid with a second component comprising at least one alcohol and combining the at least one ester with a base oil selected from the group consisting of alkylbenzenes, alkylated naphthenics, polyalkylene glycols, polyvinylethers, polyalphaolefins, mineral oils, polyol esters, and combinations thereof.

21 Claims, 1 Drawing Sheet

SYNTHETIC REFRIGERATION OIL COMPOSITION FOR HFC APPLICATIONS

CROSS-REFERENCE TO RELATED APPLICATIONS

This application is a divisional application which claims the benefit under 35 U.S.C. §121 of U.S. patent application Ser. No. 11/855,007, filed Sep. 13, 2007, which claims the benefit under 35 U.S.C. §119(e) of U.S. Provisional Application No. 60/825,839, filed Sep. 15, 2006, the disclosures of each of which are hereby incorporated herein by reference in their entirety for all purposes.

BACKGROUND

1. Field of the Invention

This invention relates generally to the field of refrigeration lubrication. More specifically, the invention relates to synthetic refrigeration oil compositions for use with primarily hydrofluorocarbons and other refrigerants as described herein.

2. Background of the Invention

Current refrigerant lubricants for hydrofluorocarbon (HFC) systems can be divided into two categories: 1) lubricants that are soluble with HFC refrigerants over a wide range of temperatures including polyol esters (POE), polyvinyl ethers (PVE) and polyalkylene glycols (PAG); and 2) lubricants that are partially or completely immiscible with HFC refrigerants such as those of hydrocarbon based oils, e.g., mineral oils (MO), alkybenzene (AB), and polyalpha olefins (PAO). It is commonly recognized that miscible oils provide good oil return for better cooling efficiency. POE is the most widely used miscible refrigeration lubricant. However, miscible oils such as POE have polar functional groups that are hygroscopic, which is undesirable for system and compressor components. POE chemical structure is also non-responsive to commonly used and accepted lubricity enhancement additives. POE also does not promote foaming in the presence of HFC refrigerant, which results in an undesirable increase in compressor noise level. On the other hand, immiscible oils provide better compressor durability and respond favorably to further lubricity enhancing additives. In addition, immiscible oils are also highly desirable for use in HFC systems because of their lower cost. However, the immiscibility of the HFC refrigerants and hydrocarbon oils causes the build up of an oil layer in the system, resulting in less efficient heat transfer and reduced system efficiency. In extreme cases, immiscibility can cause excessive amounts of oil to migrate into the system and not return to the compressor, resulting in oil starvation and ultimately catastrophic failure at the compressor. It is therefore essential to ensure adequate oil return to the refrigeration compressor to avoid loss of efficiency and/or compressor failure. POE is known by those skilled in the art to have significant lubrication deficiencies, no foam promotion characteristics, and high hygroscopicity, but is still widely used due to the overriding need to ensure adequate oil return.

Mixed refrigeration lubricant systems such as AB/POE have been proposed. Such a combination system of the miscible and immiscible lubricants directionally improves the oil return characteristics of the immiscible oils and reduces the hygroscopicity of the miscible lubricants and overall cost of the lubricant in the system. However, combining miscible and immiscible oils does not generally improve the overall compressor performance or system efficiency sufficiently to warrant change from a pure miscible lubricant system.

Compatibilizers have also been proposed as an alternative mechanism to improve the mutual solubility between the miscible and immiscible oils and thereby enable improved oil migration characteristics commensurate with oil migration characteristics of a pure miscible lubricant system. Additionally, enhanced pool boiling has been reported to result in higher heat transfer coefficients between refrigerant and refrigeration oils and thereby increase heat transfer efficiency. However, neither of these proposed solutions has been demonstrated to provide an adequate alternative to fully miscible systems. Accordingly, oil return to the refrigeration compressor remains a critical factor in such studies whether candidates are based on miscible POE, PVE or PAG chemistries or whether candidates are based on alternative lubricant system chemistries. To date, no lubricant system based on non-miscible lubricant chemistry has achieved the necessary balance of adequate oil migration/oil return to provide system efficiency and life, superior lubrication characteristics and cost effectiveness required to make such a system a viable alternative to currently accepted fully miscible systems.

The foregoing demonstrates the industry's need for a lubricant formulation that can be used with HFCs across the entire application range, without the respective deficiencies of the miscible or immiscible systems; that is a formulation that offers enhanced heat transfer and oil migration, enhanced lubrication properties, and, results in a more efficient and cost effective refrigeration system than those employing either miscible lubricants such as POE or immiscible formulations.

SUMMARY

These and other needs in the art are addressed in an embodiment described herein for a refrigeration composition comprising a mixture of an ester of a hydroxycarboxylic acid. The hydroxycarboxylic acid has a chain length ranging from 8 to 22 carbon atoms. The composition also comprises a carrier fluid, also referred to herein as a base oil, selected from the group consisting of an alkylbenzene, an alkylated naphthenic, a polyalkylene glycol, a polyvinylether, a polyalphaolefin, mineral oil, a polyol ester, and combinations thereof.

In an embodiment, a refrigeration composition comprises a mixture of an ester of a hydroxycarboxylic acid. The hydroxycarboxylic acid has at least two carboxylic acid groups. The composition additionally comprises a carrier fluid or base oil selected from the group consisting of comprising an alkylbenzene, an alkylated naphthenic, a polyalkylene glycol, a polyvinylether, a polyalphaolefin, mineral oil, a polyol ester, and combinations thereof.

In another embodiment, a refrigeration composition comprises a mixture of an ester of a hydroxycarboxylic acid. The hydroxycarboxylic acid contains a ring system. The composition further comprises carrier fluid selected from the group consisting of an alkylbenzene, an alkylated naphthenic, a polyalkylene glycol, a polyvinylether, a polyalphaolefin, mineral oil, a polyol ester, and combinations thereof.

In an embodiment, a method of making a refrigeration composition comprises providing an ester of a hydroxycarboxylic acid. The hydroxycarboxylic acid has a chain length from 8 to 22 carbons. The method also comprises adding the ester to a carrier fluid selected from the group consisting of an alkylbenzene, an alkylated naphthenic, a polyalkylene glycol, a polyvinylether, a polyalphaolefin, mineral oil, a polyol ester, and combinations thereof.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

NOTATION AND NOMENCLATURE

Figure 1:
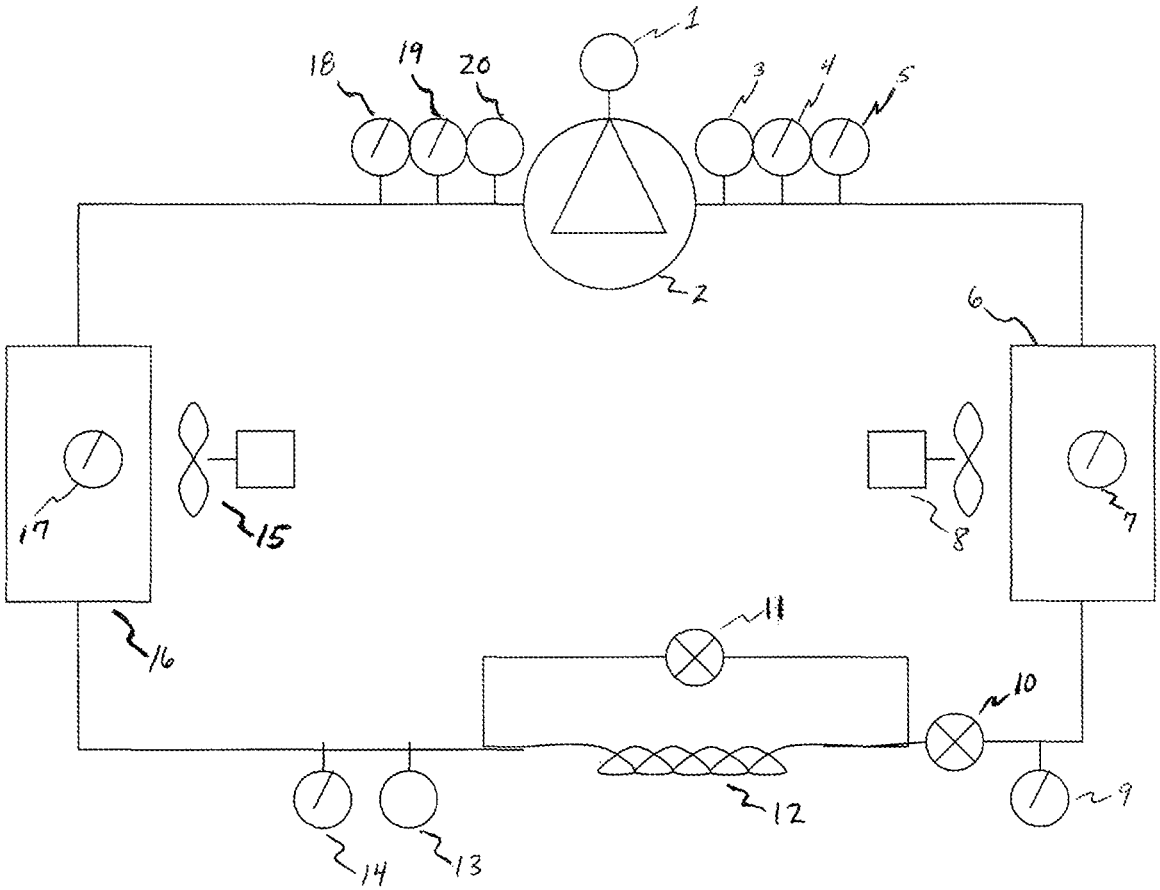
FIG. 1 is a schematic view of the testing apparatus used in the OMS testing described herein with respect to Examples 3, 5, 6, 7, 8 and 9, wherein the reference numerals 1, 3, 13, 20 represent sight glasses respectively; 2, a compressor; 4, 7, 9, 14, 17, 19, temperature thermocouples respectively; 5 and 18, pressure gauges respectively; 6, a condenser; 8 and 15, fan and motor assemblies respectively; 10, an expansion valve; 11, a bypass circuit valve; 12, a capillary tube; 16, an evaporator.

Certain terms are used throughout the following description and claims that refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ".

DETAILED DESCRIPTION

In an embodiment, a novel refrigeration oil composition comprises a mixture of an ester of a hydroxycarboxylic acid; and a base oil lubricant selected from the group consisting of an alkylbenzene, an alkylated naphthenic, a polyalkylene glycol, a polyvinylether, a polyalphaolefin, mineral oil, a polyol ester, and combinations thereof. Generally, the hydroxycarboxylic acid ester is a product of the esterification of a hydroxycarboxylic acid with an alcohol. As defined herein, a hydroxycarboxylic acid is a carboxylic acid containing at least one —COOH group and at least one isolated —OH group. Typically, the ester of the hydroxycarboxylic acid contains no more than one ester group. According to a preferred embodiment, the hydroxycarboxylic acid has a linear chain length ranging from 8 to 22 carbon atoms.

In at least one embodiment, the hydroxycarboxylic acid is a monohydroxy fatty acid. Examples of hydroxycarboxylic acids that may be esterified, including without limitation, ricinoleic acid (RA), hydroxystearic acid, hydroxylauric acid, hydroxydecanoic acid, hydroxyarachidic acid, hydroxypalmitic acid, hydroxyerucic acid, hydroxylinoleic acid, hydroxyarachidonic and combinations thereof. In certain embodiments, the hydroxycarboxylic acid comprises more than one isolated hydroxyl group. In one embodiment, the hydroxycarboxylic acid comprises more than one carboxylic acid group such as a hydroxy dicarboxylic acid. Examples of hydroxy polycarboxylic acids include without limitation, citric acid, malic acid, tartaric acid, and combinations thereof. In yet another embodiment, the hydroxycarboxylic acid contains a ring structure which may be aromatic, homocyclic, heterocyclic, etc. Examples of such hydroxy acids include without limitation, salicylic acid, dihydroxybenzoic acid, and combinations thereof. In further embodiments, the hydroxycarboxylic acid contains halogen groups, additional alkyl substituents, amine groups, and the like.

In some embodiments, the composition comprises one or more additional esters. For example, the composition may comprise an ester of a hydroxycarboxylic acid and an ester of a fatty acid. Any fatty acid may be used including, without limitation, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, oleic acid, 2-ethylhexanoic acid, and combinations thereof. In addition, the ester may have an alkoxylate portion which comprises one or more oxide monomers higher than ethylene oxide. In other embodiments, the composition may preferably comprise more than one ester of a hydroxycarboxylic acid. In other words, each ester may be produced from a different hydroxycarboxylic acid. For exemplary purposes only, in such an embodiment the composition may contain a ricinoleic acid ester and a hydroxystearic acid ester.

According to at least one embodiment, the corresponding alcohols with which the hydroxycarboxylic acid is esterified are linear or long chain alcohols, i.e., monohydric alcohols. Examples of suitable alcohols include without limitation, methanol, ethanol, caproic alcohol, caprylic alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, linolyl alcohol, linolenyl alcohol, elaeostearyl alcohol, arachidyl alcohol, gadoleyl alcohol, behenyl alcohol, erucyl alcohol, brassidyl alcohol, and combinations thereof. Alternatively, polyalkylene glycols may be reacted with the hydroxycarboxylic acid, wherein a polyalkylene glycol may be defined as comprising any of the polymer initiator/terminating functionalities commonly recognized by those familiar with the art of alkoxylation, and containing a polymer chain consisting of a measurable proportion of at least two oxide monomer types, or containing a polymer chain consisting of a single monomer type higher than ethylene oxide (propylene oxide, butylene oxide and such like). Examples therefore include, without limitation, all polyalkylene glycols not consisting of ethylene oxide in their entirety, which have at least one hydroxyl functionality and therefore may be esterified, including di-hydroxy and poly-hydroxy functionalized polyalkylene glycols.

In another embodiment, the alcohol may be a polyol such as a diol or triol. Alternatively, the alcohols may be branched, aliphatic, cyclic, or aromatic in structure.

In an embodiment, a composition comprises from about 1% to about 60% by weight of the hydroxycarboxylic acid ester, preferably from about 5% to about 40%, more preferably from about 10% to about 20%. The composition preferably contains a sufficient amount of an ester of a hydroxycarboxylic acid to result in measurable system efficiency improvements measured by the increased level of oil back to the compressors.

According to some preferred embodiments, the carrier fluid/base oil may preferably comprise miscible oils such as polyol esters, polyvinylethers or polyalkylene glycols, immiscible oils such as alkylbenzene, polyalphaolefins, alkylated naphthenics and mineral oils, and combinations thereof.

In a particular embodiment, miscible and immiscible lubricants may preferably be combined in a ratio ranging from 1% by weight miscible oil(s) to 99% by weight miscible oil(s). One of the advantages of the compositions of the embodiments described herein is their ability to be used in conjunction with lubricants or carrier fluids that are either miscible or immiscible with refrigerants primarily comprised of HFC. By way of illustration and not limitation, examples of such refrigerants for use with the compositions described herein include R134a, R125, R32, R23, R143a, R116, R152a and combinations thereof, and minority refrigerant components such as isobutene, $CO_2$, and HCFC (hydrochlorofluorocarbons), and combinations thereof.

It is important to maintain HFC fluidity across a broad range of temperatures so as not to form segregated oil layers in the refrigeration system. Segregation may result in oil deposits that can cause capillary plugging and clogs in the system. Thus, the compositions of the embodiments described are capable of maintaining HFC fluidity across a broad spectrum of temperatures ranging from about −100° C. to about 150° C., preferably from about −70° C. to about 100° C., more preferably from about −40° C. to about 20° C. Without being limited by theory, it is believed that unlike the traditional paradigm for refrigerant miscibility where the oils and the refrigerants form a homogeneous phase, the compositions of the embodiments described herein promote fluidity over the test temperature ranges through their ability to disperse the oil and the refrigerant and avoid segregated fluid layers.

In a further embodiment, the refrigeration composition comprises at least one additive component. The additive component(s) may be any commonly used refrigeration system additives known in the art to enhance lubricity and/or system stability. Examples include anti wear agents, extreme pressure lubricants, corrosion and oxidation inhibitors, metal surface deactivators, free radical scavengers, foaming and anti-foam control agents, leak detectants, and the like. Typically, these additives are present only in small amounts relative to the overall lubricant composition. However, the additives may be present at any suitable concentration. In an embodiment, the additive components are used at concentrations of from less than about 0.1% by weight to as much as about 3% by weight of each additive.

These additives may be selected on the basis of the individual system requirements. In an embodiment, lubrication enhancing additives may be included in the compositions described herein. Examples of such additives include the families of phosphites and phosphates well characterized for their lubrication enhancing benefits, and including alkyl or aryl esters of phosphoric acid and thiophosphate. These include members of the triaryl phosphate family of extreme pressure) EP lubricity additives, and tricresyl phosphates and related compounds. Additionally, the metal dialkyl dithiophosphates and other members of this family of chemicals may be used in compositions of the present invention. Other antiwear additives include lubricity esters, such as tall oil fatty esters. In other embodiments, stabilizers such as antioxidants, free radical scavengers, and water scavengers may be added to the composition. Compounds in this category can include, but are not limited to, butylated hydroxy toluene (BHT) and epoxides.

The addition of an additive allows the user to tailor the resulting composition to provide further lubricant properties. As such, the disclosed compositions are capable of delivering the optimal lubricant requirements for a wide range of HFC requirements. Further, combinations of these additives may be employed as appropriate, as is known in the art.

EXAMPLES

To further illustrate various illustrative embodiments of the present invention, the following examples are provided.

Preparation and Evaluation of Esters

Example 1

Ricinoleic Acid Ester of Isotridecanol

A ricinoleic acid (RA) ester was prepared by the esterification of ricinoleic acid with isotridecanol in the presence of titanium catalyst at 200° C. for 12 hours. Once the theoretical water was collected from the esterification, the product was neutralized and dried. The product was then filtered to remove the solid catalyst. The resulting ester had a viscosity at 40° C. of 24 centistokes (cSt) with a total acid number (TAN) of 0.31 mgKOH/g. Other esters of hydroxycarboxylic acids were synthesized and similarly tested as described below with reference to further Examples.

A benchtop foaming test was conducted at 20° C. with a 10% treat level of the above-described ester added to a base oil of ISO 68 POE with a refrigerant with a flow rate ranging from 20 cc/min to 200 cc/min. All tests were conducted in ISO 68 POE, which by itself does not foam in use with HFC refrigerants at either high or low flow rates. Results are shown in Table 1.

Example 2

Ricinoleic Acid Ester of Butanol

In this example an ester was prepared by the esterification of ricinoleic acid and butanol, according to the procedure described above with respect to Example 1.

A benchtop foaming test was conducted as described above, with the results shown in Table 1.

To test HFC fluidity, a refrigeration composition consisting of a 90:10 mixture of the HFC (134a) refrigerant:oil was sealed and immersed for 30 minutes in a low temperature bath at −40° C. after which the fluidity of the oil-in-refrigerant was assessed. A pass was recorded if the refrigerant/oil mixture exhibited full fluidity at −40° C. Results are shown in Table 1.

Example 3-3c

Ricinoleic Acid Ester of Butanol-Initiated Polyalkylene Glycol

In this example the ester was prepared by the esterification of ricinoleic acid with a butanol initiated polyalkylene glycol of 270 g/mol molecular weight, containing 50/50 wt/wt EO/PO (random) in the polymer chain, and having a single terminal hydroxyl functionality, according to the procedure described above with respect to Example 1.

A benchtop foaming test was conducted as described above, with the results shown in Table 1.

An HFC fluidity test was conducted as described above, with the results shown in Table 1.

Oil migration study (OMS) testing was done in the mini-split A/C system, previously described, equipped with a 20 feet return line, 24,000 btu/hr rotary compressor at compressor speeds between 2500 and 7000 rpm, with inverter, where sight glasses were installed in the compressor sump to measure the oil level right after the capillary tube to detect plugging, if any, at 10° C. and -40° C. mid-point evaporator temperature. HFC refrigerants used were R410a (high temperature applications) and R404a (low-temperature applications), and the total oil charge was 500 mL. The sight glass mounted on the compressor sump was calibrated by adding a known amount of oil. The corresponding oil return level was then recorded to determine whether enhanced oil return was observed when levels were compared to baseline oil return achieved when a miscible lubricant (POE) was used. Results are provided below in Table 1.

Example 4 (Comparative)

Ricinoleic Acid Ester of Polyethylene Glycol

In this example the mono-ester was prepared by the esterification of ricinoleic acid with polyethylene glycol (200 g/mol molecular weight), in a 1:1 molar ratio, according to the procedure described above with respect to Example 1.

A benchtop foaming test was conducted as described above, with the results shown in Table 1.

An HFC fluidity test was conducted as described above, with the results shown in Table 1.

Example 5-5a (Comparative)

Ricinoleic Acid Di-Ester of Polyethylene Glycol

In this example the di-ester was prepared by the esterification of ricinoleic acid with polyethylene glycol (200 g/mol molecular weight), in a 2:1 molar ratio respectively, prepared as described above with respect to Example 1.

Benchtop foaming, HFC Fluidity and OMS tests were performed as described above, with the results show below in Table 1.

Example 6-6a

Ricinoleic Acid Ester of Isopropanol

In this example the ester comprised the ricinoleic acid ester of iso-propanol, prepared as described above with respect to Example 1.

Benchtop foaming, HFC Fluidity, and OMS tests were performed as described above, with the results show below in Table 1.

Example 7 (Comparative)

ISO 68 POE

In this example, benchtop foaming and OMS tests were performed on ISO 68 POE, with the results provided below in Table 1.

Example 8 (Comparative)

ISO 32 AB

In this example, benchtop foaming, HFC Fluidity and OMS tests were performed on ISO 32 AB, with the results provided below in Table 1.

Example 9 (Comparative)

ISO 32 Mineral Oil

In this example, HFC fluidity and OMS tests were performed on ISO 32 Mineral Oil, with the results provided below in Table 1.

Discussion of Results. The application of the hydroxycarboxylic ester composition of Example 3 gave an enhanced oil return in comparison to neat miscible oil systems such as POE, in OMS testing, as indicated by comparison of the results for Examples 3a and 7. Similarly, the application of the hydroxycarboxylic ester composition of Example 6 gave an enhanced oil return in comparison to the neat miscible POE system, in OMS testing, as indicated by comparison of the results for Examples 6a and 7. For both these examples, a minimum 5-10% increase in oil level as compared to the baseline POE system was readily apparent through the sight-glass mounted above the compressor oil sump; in some individual experimental instances increases in oil level of up to a maximum of 70% was observed. Most significantly, the same level of enhancement was also observed with the immiscible oils such as AB, as indicated by comparing the results of Examples 3b and 8. Such an enhancement demonstrates a more efficient return of refrigeration oil back to the compressor for both miscible and immiscible oil systems. This unexpected and surprising result is believed to be without precedent. This level of enhancement of oil return is of great value in improving the compressor and system performance.

In the benchtop foaming testing, the hydroxycarboxylic esters Examples 3 and 6 were also observed to promote the foaming of miscible refrigerant oils in the presence of HFC refrigerant flow; as indicated by comparison of Examples 3, 3a and 6 with Example 7, and to promote the foaming of immiscible refrigerant oils in the presence of HFC refrigerant flow, as indicated by comparison of Examples 3b, 3c and 6 with Example 8. This may be interpreted as a sign of the interaction between the refrigerant and the composition, which ultimately results in improved heat transfer efficiency (and, theoretically, enhanced pool boiling). The improved foaming characteristics are also expected to result in lower compressor noise levels when compared to non-foaming lubricants.

TABLE 1

Example Results

| Ex. | Component | Kinematic Viscosity at 40° C. (cSt) | Foaming in HFC 134a w/ AB (ISO 32) (in.) | Foaming in HFC 134a. w/ POE (ISO 68) (in.) | HFC fluidity tube test* | HFC 410a OMS Test** | 410a OMS Capillary plugging (−40° C.)* | HFC 404a QMS Test** | 404a OMS Capillary plugging (−40° C.)* |
|---|---|---|---|---|---|---|---|---|---|
| 1 | RA ester of isotridecanol | 24.0 | — | 1.5 (10% component "1", 90% POE) | — | | | | |
| 2 | RA ester of butanol | 20.3 | — | 0.5 (10% component "2", 90% POE) | P | | | | |
| 3 | RA ester of butanol initiated EO/PO random PAG | 26.6 | — | 2.5 (10% component "3", 90% POE) | P | | | | |
| 3a | 15% ester "3" in 85% ISO 68 POE | 55.1 | N/A | 5.0 | P | | | X, Y | P |

TABLE 1-continued

Example Results

| Ex. | Component | Kinematic Viscosity at 40° C. (cSt) | Foaming in HFC 134a w/ AB (ISO 32) (in.) | Foaming in HFC 134a. w/ POE (ISO 68) (in.) | HFC fluidity tube test* | HFC 410a OMS Test** | 410a OMS Capillary plugging (−40° C.)* | HFC 404a QMS Test** | 404a OMS Capillary plugging (−40° C.)* |
|---|---|---|---|---|---|---|---|---|---|
| 3b | 15% ester "3" in 85% ISO 32 AB | 27.2 | 5.5 | N/A | | | | X, Y | P |
| 3c | 5% ester "3" in 95% ISO 32 AB | 26.4 | 6.0 | N/A | P | | | X | P |
| 4 | RA mono-ester of PEG | 42.0 | — | 4.0 (10% component "4", 90% POE) | F | | | | |
| 5 | RA di-ester of PEG | 123.0 | 6.0 (10% component "5", 90% AB) | 3.0 (10% component "5", 90% POE) | F | | | | |
| 5a | 15% ester "5" in 85% ISO 68 POE | — | — | — | — | | | | F |
| 6 | RA ester of isopropanol | 125 | 6.5 (10% component "6", 90% AB) | 3.5 (10% component "6", 90% POE) | F | | | | |
| 6a | 15% ester "6" in 85% ISO 68 POE | — | — | — | — | X, Y | P | | |
| 7 | ISO 68 POE | 68.0 | N/A | Nil | P | X | P | X | P |
| 8 | ISO 32 AB | 27.0 | 1.0 | N/A | P | X | M | X | M |
| 9 | ISO 32 MO | 32.0 | N/A | N/A | F | X | M | | |

*Key:
P—Pass
F—Fail
M—Lower Fluidity Observed
**Key:
X—Test Performed
Y—Enhanced Oil Return Observed While the preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein. The discussion of a reference in this disclosure is not an admission that it is prior art to the present invention, especially any reference that may have a publication date after the priority date of this application.

What is claimed is:

1. A method of making a refrigeration composition, the method comprising:

preparing at least one ester by esterifying a first component comprising at least one hydroxycarboxylic acid with a second component comprising at least one alcohol; and combining the at least one ester with a base oil selected from the group consisting of alkylbenzenes, alkylated naphthenics, polyalkylene glycols, polyvinylethers, polyalphaolefins, mineral oils, polyol esters, and combinations thereof.

2. The method of claim 1 wherein the at least one hydroxycarboxylic acid comprises from 8 to 22 carbons.

3. The method of claim 1, further comprising incorporating a refrigerant selected from the group consisting of R134a, R125, R32, R23, R143a, R116, R152a, and combinations thereof.

4. The method of claim 3 further comprising incorporating a minority refrigerant component selected from the group consisting of isobutene, $CO_2$, HCFC's, and combinations thereof.

5. The method of claim 1 wherein the at least one hydroxycarboxylic acid is selected from the group consisting of monohydroxy fatty acids and hydroxycarboxylic acids comprising more than one carboxylic acid group.

6. The method of claim 5 wherein the at least one hydroxycarboxylic acid is selected from the group consisting of hydroxycarboxylic acids comprising more than one carboxylic acid group, hydroxylinoleic acid, hydroxyerucic acid, hydroxyarachidonic acid, ricinoleic acid, and combinations thereof.

7. The method of claim 5 wherein the at least one hydroxycarboxylic acid comprises more than one carboxylic acid group.

8. The method of claim 7 wherein the at least one hydroxycarboxylic acid is selected from the group consisting of citric acid, tartaric acid, malic acid, and combinations thereof.

9. The method of claim 5 wherein the at least one hydroxycarboxylic acid is selected from the group consisting of hydroxystearic acid, hydroxylauric acid, hydroxydecanoic acid, hydroxyarachidic acid, hydroxypalmitic acid, hydroxylinoleic acid, hydroxyerucic acid, hydroxyarachidonic acid, ricinoleic acid, and combinations thereof.

10. The method of claim 9 wherein the at least one hydroxycarboxylic acid is selected from the group consisting of hydroxylinoleic acid, hydroxyerucic acid, hydroxyarachidonic acid, ricinoleic acid, and combinations thereof.

11. The method of claim 1 wherein the at least one hydroxycarboxylic acid comprises a ring system.

12. The method of claim 11 wherein the at least one hydroxycarboxylic acid is selected from the group consisting of salicylic acid, dihydroxybenzoic acid, and combinations thereof.

13. The method of claim 1 wherein the at least one alcohol is selected from the group consisting of alcohols that are linear, long chain, or both.

14. The method of claim 1 wherein the at least one alcohol is selected from the group consisting of monohydric alcohols.

15. The method of claim 14 wherein the at least one alcohol comprises isotridecanol.

16. The method of claim 1 wherein the at least one alcohol is selected from the group consisting of polyalkylene glycols.

17. The method of claim 16 wherein the at least one ester has an alkoxylate portion comprising one or more oxide monomers higher than ethylene oxide.

18. The method of claim 17 wherein the at least one hydroxycarboxylic acid comprises ricinoleic acid.

19. The method of claim 1 further comprising incorporating an ester of a fatty acid.

20. The method of claim 1 wherein the at least one ester comprises from about 1% by weight to about 60% by weight of the refrigeration composition.

21. The method of claim 1 wherein the at least one ester is a monoester.

* * * * *